US008740162B1

(12) United States Patent
Morgan

(10) Patent No.: US 8,740,162 B1
(45) Date of Patent: Jun. 3, 2014

(54) DIAPER TREE

(76) Inventor: Mitchell Glenn Morgan, Torrance, CA (US)

( * ) Notice: Subject to any disclaimer, the term of this patent is extended or adjusted under 35 U.S.C. 154(b) by 228 days.

(21) Appl. No.: 13/533,013

(22) Filed: Jun. 26, 2012

Related U.S. Application Data

(60) Provisional application No. 61/504,430, filed on Jul. 5, 2011.

(51) Int. Cl.
*A47B 96/06* (2006.01)

(52) U.S. Cl.
USPC ..... 248/231.51; 248/229.13; 248/231.81; 248/316.1; 248/316.5; 248/316.7; 211/119.006

(58) Field of Classification Search
USPC ..... 248/231.51, 229.13, 229.23, 231.81, 248/228.4, 316.1, 316.5, 316.7; 24/489; 211/49.1, 71.01, 119.006; 5/93.1
See application file for complete search history.

(56) References Cited

U.S. PATENT DOCUMENTS

| | | | | |
|---|---|---|---|---|
| 5,135,189 | A * | 8/1992 | Ghazizadeh | 248/104 |
| 5,489,075 | A * | 2/1996 | Ible | 248/104 |
| 6,598,837 | B1 * | 7/2003 | Howard et al. | 248/103 |
| 7,165,762 | B1 * | 1/2007 | Duzick | 269/45 |
| 7,472,871 | B1 * | 1/2009 | Demontegnac | 248/104 |
| 8,602,662 | B1 * | 12/2013 | Mans | 396/428 |
| 8,662,324 | B2 * | 3/2014 | Robinson | 211/126.4 |
| 2010/0122962 | A1 * | 5/2010 | Zhang et al. | 211/85.29 |
| 2011/0192951 | A1 * | 8/2011 | Gooch | 248/316.7 |

* cited by examiner

*Primary Examiner* — Todd M Epps
(74) *Attorney, Agent, or Firm* — Plager Schack, LLP

(57) ABSTRACT

A diaper tree comprises a vertical stalk mechanically coupled to a spring loaded clamp and a bracket. The bracket is mechanically coupled to a platform left arm and the platform left arm is connected to a platform right arm.

1 Claim, 4 Drawing Sheets

DIAPER TREE

CROSS REFERENCE TO RELATED APPLICATIONS

This application claims priority to U.S. Provisional Application No. 61/504,430 filed on Jul. 5, 2011.

FIELD OF THE INVENTION

This invention relates to home furnishings.

BACKGROUND OF THE INVENTION

Changing a child's diaper can be a time-consuming and stressful process. Retrieving, unfolding and preparing a disposable diaper requires the use of two hands. With both hands being used to handle the diaper, there is an increased potential for infant injuries if the child makes a sudden movement while on a changing table or station. Parents are unable to keep a secure hold on their child while also trying to access, prepare and maneuver the diaper. A more safe and efficient method is needed and is provided by the disclosed invention

BRIEF SUMMARY OF THE INVENTION

A diaper tree comprises a vertical stalk mechanically coupled to a spring loaded clamp and a bracket. The bracket is mechanically coupled to a platform left arm and the platform left arm is connected to a platform right arm.

BRIEF DESCRIPTION OF THE SEVERAL VIEWS OF THE DRAWINGS

Figure 1:
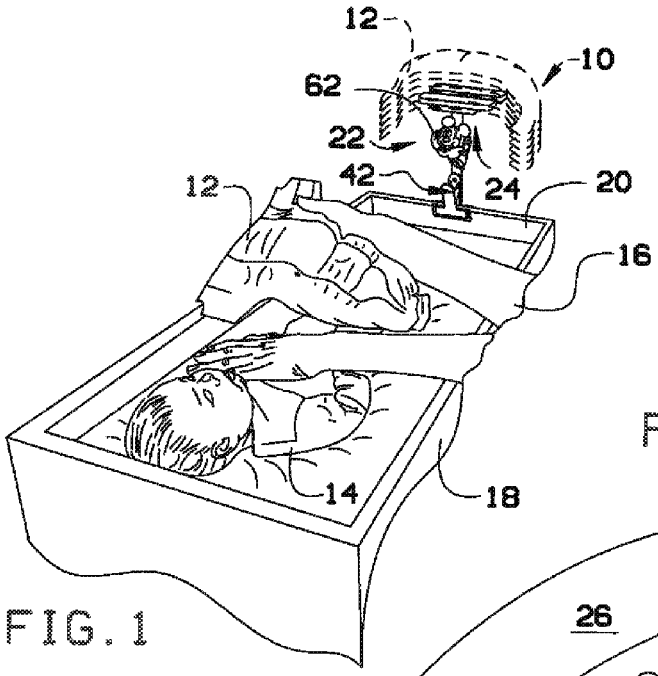

Having thus described the invention in general terms, reference will now be made to the accompanying drawings, which are not necessarily drawn to scale, and wherein:

FIG. 1 is perspective view of the invention shown in use.

Figure 2:
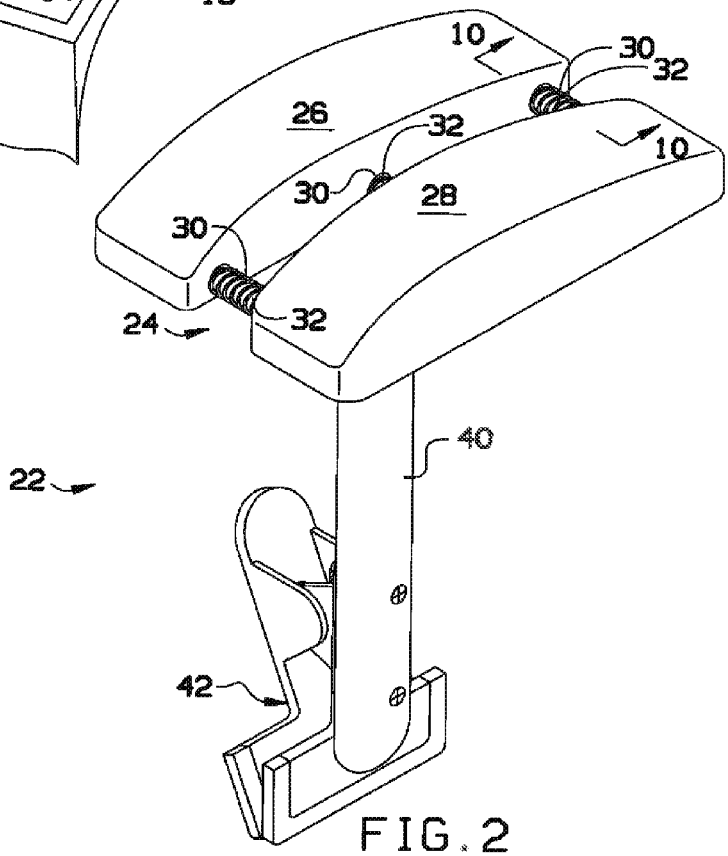

FIG. 2 is a perspective view of the invention.

Figures 3, 4, 5:
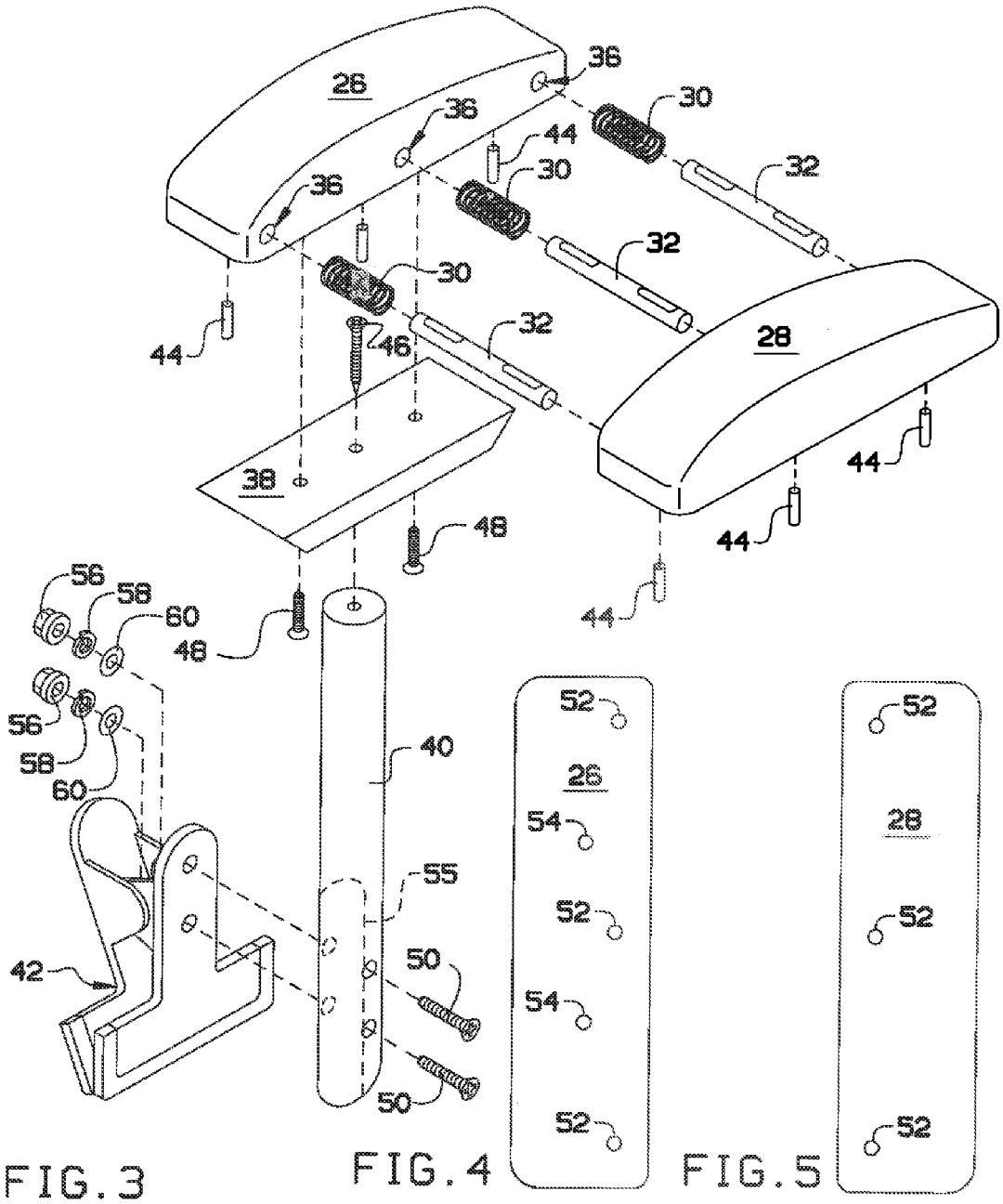

FIG. 3 is an exploded view of the invention.

FIG. 4 is a bottom view of the diaper platform left arm only and illustrating hole pattern.

FIG. 5 is a bottom view of the diaper platform right arm only and illustrating hole pattern.

Figure 6:
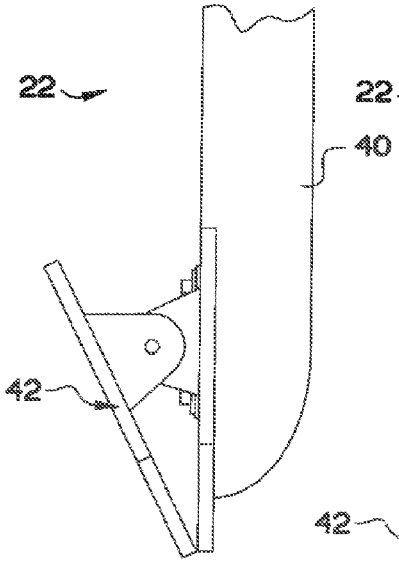

FIG. 6 is a detail side view of the invention.

Figure 7:
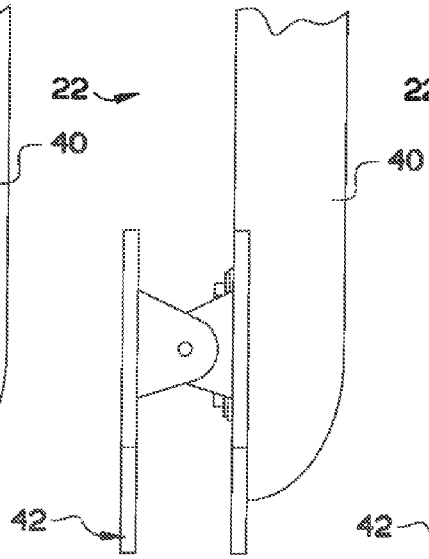

FIG. 7 is a detail side view of the invention exemplifying rotational motion of the spring loaded clamp.

Figure 8:
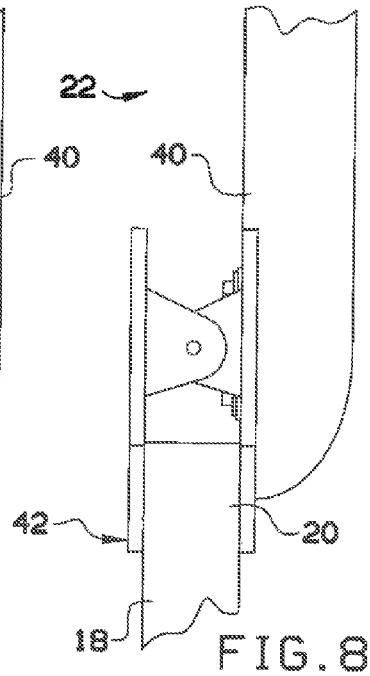

FIG. 8 is a detail side view of the invention exemplifying clamped configuration.

Figure 9:
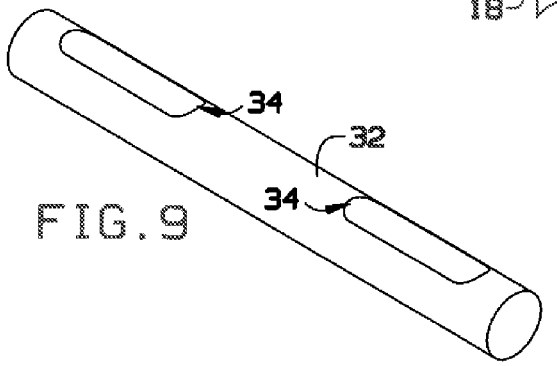

FIG. 9 is a perspective view of compression spring piston only.

Figure 10:
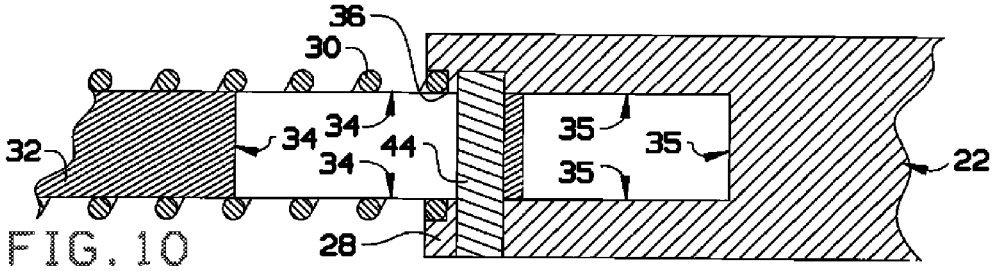

FIG. 10 is a section detail view of the invention along line 10-10 in FIG. 2.

Figure 11:
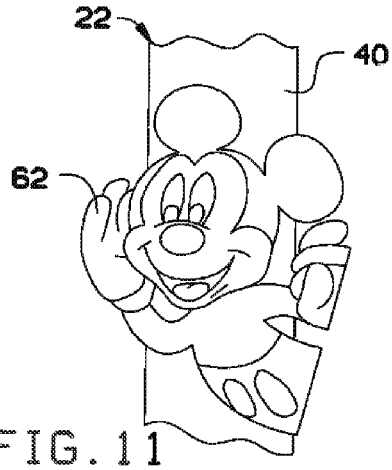

FIG. 11 is a detail front view of an alternate configuration of the invention.

Figure 12:
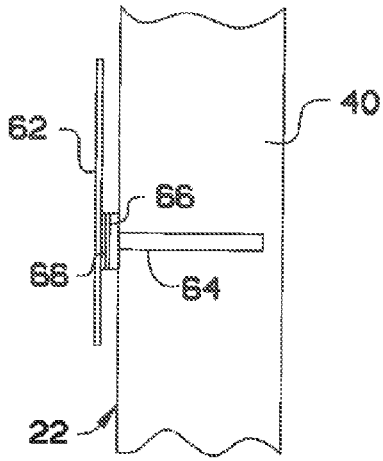

FIG. 12 is a side view of an alternate configuration of the invention.

Figure 13:
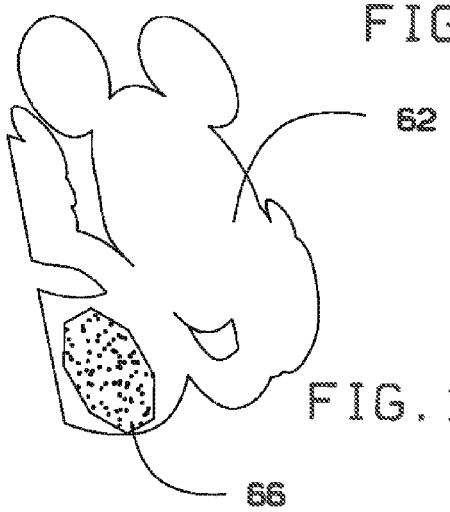

FIG. 13 is a rear view of the media only.

Figure 14:
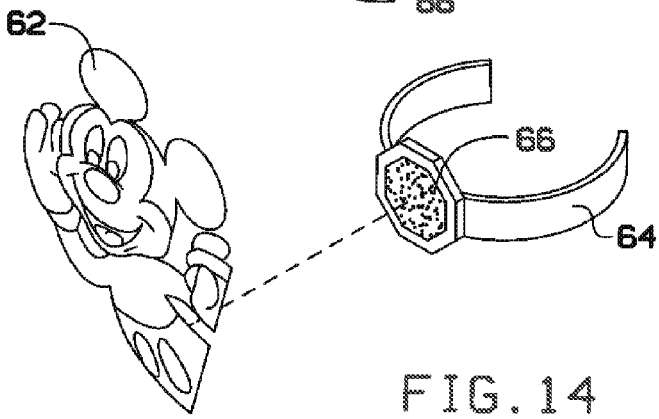

FIG. 14 is an exploded detail view of the invention illustrating alternate configuration components only.

Figure 15:
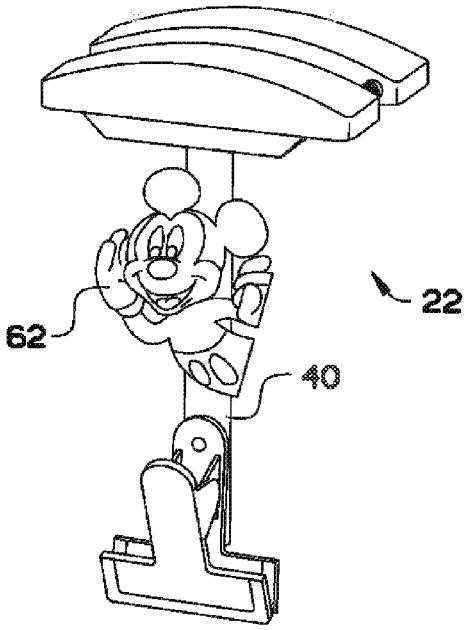

FIG. 15 is a perspective view of an alternate configuration of the invention.

DETAILED DESCRIPTION OF THE INVENTION

Embodiments of the present invention overcome many of the obstacles associated with preparing and administering the fitting of a disposable diaper, and now will be described more fully hereinafter with reference to the accompanying drawings that show some, but not all embodiments of the claimed inventions. Indeed, the invention may be embodied in many different forms and should not be construed as limited to the embodiments set forth herein. Rather, these embodiments are provided so that this disclosure will satisfy applicable legal requirements. Like numbers refer to like elements throughout.

FIG. 1 shows the invention in use. User 16 desires to change diaper 12 of child 14 on changing table 18. Changing table 18 comprises changing table lip 20. To make this process safer and easier, user 16 uses diaper tree 22.

Diaper tree 22 comprises spring loaded clamp 42, platform 24 and media 62 as shown in the Figures below. A stack 10 of diapers 12 rests on platform 24 as shown in FIG. 2.

FIG. 2 shows diaper tree 22 in more detail, vertical stalk 40 is mechanically coupled to spring loaded clamp 42 and platform 24 as shown in FIG. 3.

Platform 24 comprises platform left arm 26 mechanically coupled to platform right arm 28 by first compression spring piston 32, second compression spring piston 32 and third compression spring piston 32. First compression spring piston 32 is immediately adjacent to first compression spring 30. Second compression spring piston 32 is immediately adjacent to second compression spring 30. Third compression spring piston 32 is immediately adjacent to third compression spring 30.

FIG. 3 shows an assembly view of diaper tree 22. Vertical stalk 40 comprises clamp recess 55 which can be mechanically coupled to spring loaded clamp 42 by inserting clamp fastener 50 into spring loaded clamp 42 and completing the mechanical couple with clamp washer 60, lock washer 58 and clamp nut 56.

Vertical stalk 40 is further mechanically coupled to bracket 38 by stalk fastener 46. Bracket 38 is mechanically coupled to platform left arm 26 by bracket fastener 48. Bracket fastener 48 is coupled into arm bracket hole 54 as shown in FIG. 4. As noted above, compression spring piston 32 is immediately adjacent to compression spring 30 and is mechanically coupled to either platform left arm 26 or platform right arm 28 by inserting compression spring piston 32 into compression spring piston cylinder 36 and completing the mechanical couple by inserting guide pin 44 into guide pin locating hole 52 and then into guide pin slot 34 in compression spring piston 32.

FIG. 4 and FIG. 5 show a bottom view of platform left arm 26 and platform right arm 28. Platform left arm 26 comprises bracket hole 54 and guide pin locating hole 52, whereas platform right arm 28 comprises guide pin locating hole 52.

FIG. 6, FIG. 7 and FIG. 8 show the motion of spring loaded clamp 42. As noted above diaper tree 22 comprises vertical stalk 40 which is mechanically coupled to spring loaded clamp 42. Spring loaded clamp 42 comprises a spring which holds spring loaded clamp 42 together as shown in FIG. 6. However, a user's kinetic energy can deform spring loaded clamp 42 to the shape shown in FIG. 7. The deformed spring loaded clamp 42 can be mechanically coupled to changing table lip 20 as shown in FIG. 8.

FIG. 9 shows compression spring piston 32 in more detail. Compression spring piston 32 comprises first guide pin slot 34 and a second guide pin slot 34. In some embodiments, first guide pin slot 34 is aligned with guide pin locating hole 52 on platform left arm 26, so that guide pin 44 can be inserted into guide pin locating hole 52 and into first guide pin slot 34. Similarly, second guide pin slot 34 is aligned with guide pin locating hole 52 on platform right arm 28, so that guide pin 44 can be inserted into guide pin locating hole 52 and into second guide pin slot 34. This is shown in more detail in FIG. 10.

FIG. 10 shows a section view of compression spring piston 32 in use. As noted above, compression spring piston 32 is immediately adjacent to compression spring 30. Guide pin 44 is inserted through platform right arm 28 and into compression spring piston guide pin slot 34 to create a fully-floating piston action. Compression spring piston 32 travels freely within piston cylinder area 35 allowing the in and out motion to accommodate various diaper sizes.

Therefore, platform left arm 26 is mechanically coupled to first compression spring piston 32 by first guide pin 44, second compression spring piston 32 by second guide pin 44 and third compression spring piston 32 by third guide pin 44. Platform right arm 28 is mechanically coupled to first compression spring piston 32 by fourth guide pin 44, second compression spring piston 32 by fifth guide pin 44 and third compression spring piston 32 by sixth guide pin 44. As noted above, first compression spring piston 32 is immediately adjacent to the first compression spring 30. Second compression spring piston 32 is immediately adjacent to a second compression spring 30. Third compression spring piston 32 is immediately adjacent to third compression spring 30. This shows how platform left arm 26 is connected to platform right arm 28.

FIG. 11, FIG. 12, FIG. 13, FIG. 14 and FIG. 15 show media 62 in more detail. Media clip 64 can be coupled to vertical stalk 40 by sliding media clip 64 over vertical stalk 40. Media clip 64 is mechanically coupled to hook and loop fastener 66. Similarly, media 62 is mechanically coupled to hook and loop fastener 66. A user can attach media 62 to media clip 64 with hook and loop fastener 66.

To use the device, a first diaper is unfolded, turned inside-out and stretched across platform left arm 26 and platform right arm 28. A first diaper 12 elastic leg gathers catches the underside of platform left arm 26 and platform right arm 28. Platform left arm 26 and platform right arm 28 provide consistent outward pressure from the first compression spring 30 and compression spring piston 32, second compression spring 30 and compression spring piston 32 and third compression spring 30 and compression spring piston 32 to hold the first diaper in place. As a plurality of diapers 12 are stacked one on top of the other, platform left arm 26 and platform right arm 28 maintain a consistent outward pressure to hold the stack of diapers in place. Diapers 12 are stacked with the inside of the first diaper 12 facing upwards for quick and easy placement and positioning under the bottom of infant 14.

That which is claimed:

1. A diaper tree, comprising, a vertical stalk mechanically coupled to a spring loaded clamp and a bracket, the bracket is mechanically coupled to a platform left arm; and the platform left arm is connected to a platform right arm; the platform left arm is mechanically coupled to a first compression spring piston by a first guide pin, a second compression spring piston by a second guide pin, a third compression spring piston by a third guide pin; the platform right arm is mechanically coupled to the first compression spring piston by a fourth guide pin, the second compression spring piston by a fifth guide pin; and the third compression spring piston by a sixth guide pin; the first compression spring piston is immediately adjacent to a first compression spring; the second compression spring piston is immediately adjacent to a second compression spring; the third compression spring piston is immediately adjacent to a third compression spring; a media is mechanically coupled to a media clip, which is further mechanically coupled to the vertical stalk; and a plurality of diapers are stretched across the platform left arm and the platform right arm to form a stack of diapers;

wherein the stack of diapers is held in place by the first compression spring and the first compression spring piston, the second compression spring and the second compression spring piston, and the third compression spring and the third compression spring piston.

* * * * *